US009365969B2

(12) United States Patent
Tack

(10) Patent No.: US 9,365,969 B2
(45) Date of Patent: Jun. 14, 2016

(54) STEAM GENERATOR IRON

(71) Applicant: KONINKLIJKE PHILIPS N.V., Eindhoven (NL)

(72) Inventor: Johannes Willem Tack, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 0 days.

(21) Appl. No.: 14/355,851

(22) PCT Filed: Oct. 26, 2012

(86) PCT No.: PCT/IB2012/055901

§ 371 (c)(1),
(2) Date: May 2, 2014

(87) PCT Pub. No.: WO2013/068870

PCT Pub. Date: May 16, 2013

(65) Prior Publication Data

US 2014/0298693 A1 Oct. 9, 2014

Related U.S. Application Data

(60) Provisional application No. 61/556,989, filed on Nov. 8, 2011.

(51) Int. Cl.

| | |
|---|---|
| ***D06F 75/20*** | (2006.01) |
| ***D06F 75/12*** | (2006.01) |
| ***D06F 75/10*** | (2006.01) |
| ***D06F 75/38*** | (2006.01) |

(52) U.S. Cl.

CPC ..... *D06F 75/20* (2013.01); *D06F 75/10* (2013.01); *D06F 75/12* (2013.01); *D06F 75/38* (2013.01)

(58) Field of Classification Search

CPC ..... D06F 75/00; D06F 75/06; D06F 75/10; D06F 75/12; D06F 75/14; D06F 75/18; D06F 87/00

USPC ..... 38/74, 77.6, 77.8, 77.82, 77.9, 82, 85; 68/222

See application file for complete search history.

(56) References Cited

U.S. PATENT DOCUMENTS

| | | | | |
|---|---|---|---|---|
| 1,431,419 | A * | 10/1922 | Pollard | D06F 75/06 38/77.6 |
| 1,799,281 | A | 4/1931 | Cissell | |
| 1,958,876 | A | 5/1934 | Wright | |
| 1,969,583 | A * | 8/1934 | Skolnik | 38/77.83 |

(Continued)

FOREIGN PATENT DOCUMENTS

| | | | |
|---|---|---|---|
| DE | 3545753 | A1 | 6/1987 |
| DE | 102004032361 | A1 | 8/2005 |

(Continued)

*Primary Examiner* — Ismael Izaguirre

(57) ABSTRACT

The present application relates to a steam generator iron. The steam generator iron has a steam passageway along which steam flows, the steam passageway having a first section (13) and a second section (16) extending from the first section (13). A flow stabilizing element (24, 35, 38) is disposed at the transition of the steam passageway from the first section (13) to the second section (16). Therefore, the generation of noise at the transition and the flow resistance in the steam passageway is minimized as steam flows along the steam passageway. The present application also relates to an insert for a steam generator iron.

33 Claims, 6 Drawing Sheets

(56) References Cited

U.S. PATENT DOCUMENTS

| | | | | | |
|---|---|---|---|---|---|
| 2,350,452 | A | * | 6/1944 | Envall | 38/77.83 |
| 2,365,332 | A | * | 12/1944 | Cissell | 38/77.6 |
| 2,839,195 | A | * | 6/1958 | Reimers | B01J 47/002 210/249 |
| 2,940,195 | A | * | 6/1960 | Jepson | 38/77.6 |
| 4,057,918 | A | | 11/1977 | Zeier | |
| 5,279,054 | A | * | 1/1994 | Chasen | 38/77.7 |
| 5,279,055 | A | * | 1/1994 | Eckert et al. | 38/77.83 |
| 2003/0221906 | A1 | | 12/2003 | Sherikar | |
| 2012/0042547 | A1 | * | 2/2012 | Pang et al. | 38/77.6 |
| 2013/0125428 | A1 | * | 5/2013 | Tamminga et al. | 38/14 |

FOREIGN PATENT DOCUMENTS

| | | | |
|---|---|---|---|
| WO | 03062518 | A1 | 7/2003 |
| WO | 2008065619 | A1 | 6/2008 |
| WO | 2008075308 | A2 | 6/2008 |
| WO | 2010139599 | A3 | 12/2010 |

* cited by examiner

STEAM GENERATOR IRON

This application is the U.S. National Phase application under 35 U.S.C. §371 of International Application No. PCT/IB2012/055901, filed on Oct. 26, 2012, which claims the benefit of U.S. Provisional Application No. 61/556,989 filed on Nov. 8, 2011. These applications are hereby incorporated by reference herein.

FIELD OF THE INVENTION

The present invention relates to a steam generator iron.

BACKGROUND OF THE INVENTION

A steam generator iron is used to remove creases from the fabric of a garment or other material. Such a steam generator iron comprises a head unit having a main body with a handle which is held by a user, and a sole plate with a planar surface which is pressed against the fabric of a garment. A water receiving chamber and a steam generating unit are disposed in the main body, so that water is fed from the water receiving chamber into the steam generating unit and converted into steam. The steam then flows along a steam passageway and is discharged from the steam generator iron through vent holes in the sole plate towards the fabric of a garment. The steam is used to heat up and momentarily moisten the fabric of the garment in an attempt to obtain effective removal of creases from the fabric.

Steam generator irons are generally optimised for a high steam output rate. However, such a high fluid flow velocity can produce high sound power levels due to flow instabilities, for example turbulence or vortices, as the fluid flows along the flow path. In particular, flow instabilities may be formed due to a transition of the flow from one section of a steam passageway to another section, a change in direction or an obstacle in the flow path. Moreover, it is known that some geometrical configurations of the flow path can lead to a loud whistling noise being generated due to vortices being generated in the fluid flow. Although it is possible to limit the generated noise levels by altering the geometrical configuration of the flow path, for example by increasing the cross-sectional area of the flow path, the extent of the reduction is limited.

SUMMARY OF THE INVENTION

It is an object of the invention to provide a steam generator iron which substantially alleviates or overcomes the problems mentioned above.

According to the present invention, there is provided a steam generator iron comprising a steam passageway along which steam flows having a first section and a second section extending from the first section, wherein a flow stabilising element is disposed at the transition of the steam passageway from the first section to the second section.

An advantage of the above arrangement is that the generation of noise at the transition is minimised as steam flows along the steam passageway. This ensures that the noise levels generated during use of the steam generator iron are minimised. The above arrangement also reduces the resistance to flow as the steam flows along the steam passageway by stabilising the flow of steam in the steam passageway. Furthermore, the above arrangement allows for a more compact design.

The first section may define a cyclonic chamber and the first section may be configured to generate a rotational flow of steam and water in the chamber. Therefore, a cyclonic chamber may be used to minimise the flow of excess water from the steam generator iron whilst minimising the noise level generated by a steam passageway having a cyclonic chamber.

Advantageously, the flow stabilising element extends into the first section. The flow stabilising element may be formed from a mesh or a foam, and may be formed from a plastic, ceramic, or metal.

Conveniently, the flow stabilising element is formed from an intertwined metal wire mesh. This arrangement creates a form-stable and flexible mesh.

Preferably, the intertwined metal wire mesh is a stainless steel metal wire mesh.

In one embodiment, the intertwined wire mesh is formed from a wire having a diameter of 0.01 mm to 2 mm.

Preferably, the intertwined wire mesh is formed from a wire having a diameter of 0.03 to 0.40 mm.

The intertwined wire mesh may be formed from a wire having a packing density of 5% to 80%.

Preferably, wire mesh is formed from a wire having a packing density of 10% to 30%.

Advantageously, the second section is configured to have a different geometrical configuration to the first section.

The diameter of the second section of the steam passageway may be smaller than the diameter of the first section.

This arrangement allows the noise level at the transition of the steam passageway from a large diameter to a small diameter to be minimised.

Conveniently, the longitudinal axis of the second section of the steam. passageway diverges from the longitudinal axis of the first section of the steam passageway.

In one embodiment, the second section extends from a side wall of the first section.

Therefore, the noise level generated by a steam passageway having the above arrangements is minimised.

The second section may comprise a tubular portion with a free end of the tubular portion protruding into a flow path formed in the first section. Advantageously, the transition to the second section from the first section is formed at the free end of the tubular portion.

The steam passageway may comprise a third section extending from the second section, the flow stabilising element extending to the transition of the steam passageway from the second section to the third section.

According to another aspect of the invention, there is provided a steam generator iron 50 comprising a head unit 40 and a base unit 42, wherein a steam passageway is disposed in the head unit 40 and a water receiving chamber and/or a steam generating unit is disposed in the base unit 42 and water and/or steam is supplied from the base unit 42 to the head unit 40 through a hose 44.

According to another aspect of the invention, there is provided an insert for a steam generator iron comprising a flow stabilising element configured to be disposed in a steam passageway of a steam generator iron and having at least one steam flow path formed therethrough so that, when the insert is disposed in a steam passageway, the flow of steam along a steam passageway is stabilised.

These and other aspects of the invention will be apparent from and elucidated with reference to the embodiments described hereinafter.

BRIEF DESCRIPTION OF THE DRAWINGS

Embodiments of the invention will now be described, by way of example only, with reference to the accompanying drawings, in which.

DETAILED DESCRIPTION OF THE EMBODIMENTS

Figure 1:
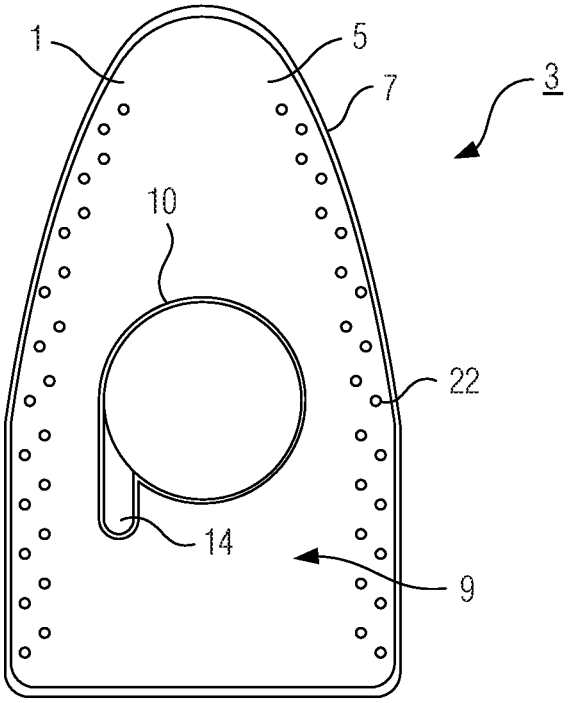
FIG. 1 shows a diagrammatic plan view from above of a lower part of a steam generator iron sole plate.
Figure 2:
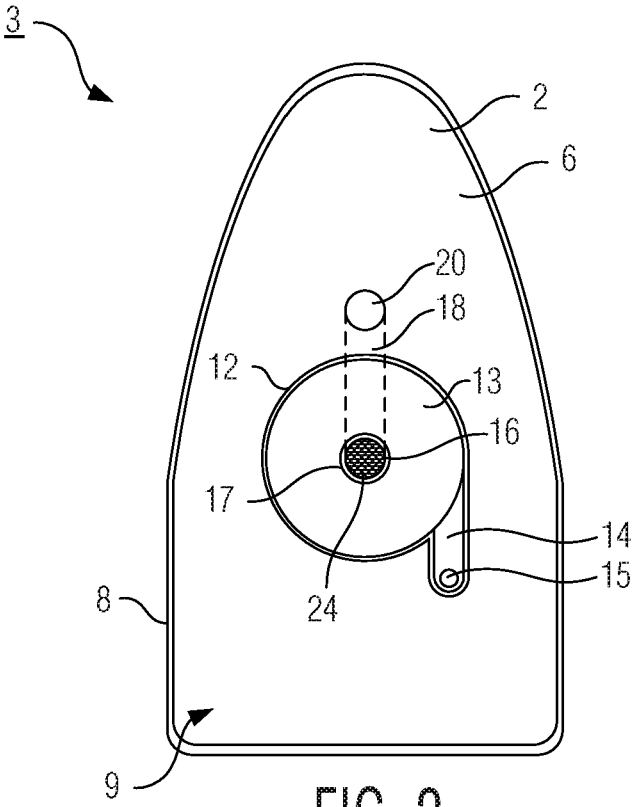
FIG. 2 shows a diagrammatic plan view from below of an upper part of steam generator iron sole plate corresponding to the lower part shown in FIG. 1.

Referring now to FIGS. 1 and 2, a lower part 1 and an upper part 2 of a sole plate 3 for a steam generator iron is shown. In FIG. 1 a top face 5 of the sole plate lower part 1 is shown, and in FIG. 2 a bottom face 6 of the sole plate upper part 2 is shown. A lower outer rim 7 upstands from and extends around the peripheral edge of the top face 5 of the sole plate lower part 1, and an upper outer rim 8 upstands from and extends around the peripheral edge of the bottom face 6 of the sole plate upper part 2.

Such a steam generator iron is used to apply steam to a fabric of a garment to remove creases from the fabric. Although the embodiments described below will relate to applying steam to the fabric of a garment, it will be appreciated that such a steam generator iron may be used to remove creases from other fabrics and materials.

When assembled, the lower and upper parts 1, 2 of the sole plate 3 are fixedly mounted to each other such that the top and bottom faces 5, 6 oppose each other, and are spaced from each other, to form a steam dispersal space 9. The lower outer rim 7 abuts against and engages with the upper outer rim 8, and fixing elements (not shown) fixedly mount the lower and upper parts 1, 2 to each other to form an assembled sole plate 3. The fixing elements may include, but are not limited to, rivets, bolts, weldings and an adhesive. The sole plate 3 is formed from a rigid, heat-conducting material, such as stainless steel or an aluminum metal or plastic soleplate with a ceramic coating on a bottom face (not shown) of the sole plate lower part 1 against which a garment to be pressed is disposed.

A lower circular wall 10 upstands from the top face 5 of the sole plate lower part 1, and a corresponding upper circular wall 12 upstands from the bottom face 6 of the sole plate upper part 2. When assembled the lower and upper circular walls 10, 12 align with each other and abut against each other to form a cylindrical cyclone chamber 13. An inlet cavity 14 extends tangentially from the cyclone chamber 13 and forms an opening in the lower and upper cylindrical walls 10, 12. A steam inlet 15 is formed through the part of the bottom face 6 of the sole plate upper part 2 forming a face of the inlet cavity 14 through which steam at a high pressure flows.

Figure 4:
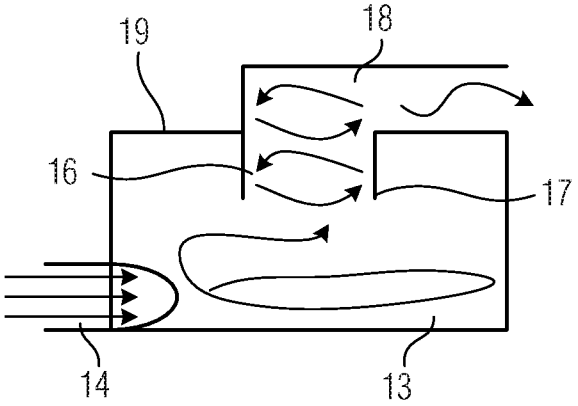
FIG. 4 shows a diagrammatic view of a steam passageway through a section of the steam generator iron sole plate shown in FIGS. 1 and 2 with a flow stabilising element removed.
Figure 5:
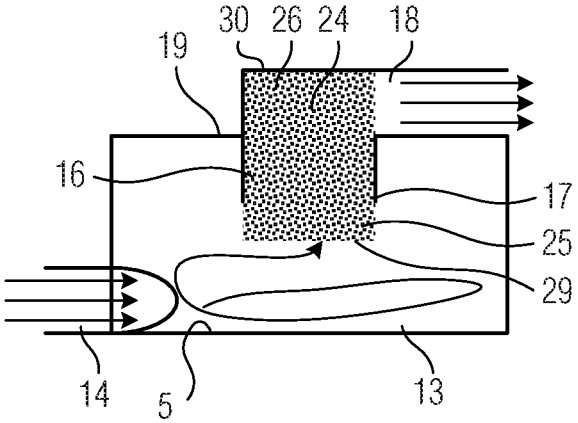
FIG. 5 shows a diagrammatic view of a steam passageway through a section of the steam generator iron sole plate shown in FIGS. 1 and 2 with a flow stabilising element disposed in the steam passageway.

A tubular steam outlet 16 upstands in the cyclone chamber 13 and extends along the central axis of the cylindrical cyclone chamber 13. The steam outlet 16 protrudes into the cyclone chamber 13 and has a free end 17 disposed in the cyclone chamber 13. The steam outlet 16 forms a cylindrical bore with an opening at the free end 17. A diagrammatic view of the cyclone chamber 13 and tubular steam outlet 16 is shown in FIGS. 4 and 5. The steam outlet 16 extends through the bottom face 6 of the sole plate upper part 2 and communicates with a steam conduit 18. The steam conduit 18 extends along a top face 19 of the sole plate upper part 2 to a steam conduit exit aperture 20 formed through the sole plate upper part 2. Therefore, the steam conduit 18 fluidly communicates the steam outlet 16 in the cyclone chamber 13 with the steam conduit exit aperture 20, and the steam conduit exit aperture 20 fluidly communicates with the steam dispersal space 9.

A plurality of steam apertures 22 are formed through the sole plate lower part 1 extending between the top face 5 of the lower part 1 and the bottom face of the lower part 1. The holes are spaced around the periphery of the sole plate lower part 1 and fluidly communicate the steam dispersal space 9 with the bottom face of the lower part 1 of the sole plate 3.

The sole plate 3 forms part of a steam generator iron 50 head unit 40 (not shown) of the steam generator iron 50. The steam generator iron 50 head unit 40 also comprises a main body (not shown) to which the sole plate is mounted and a handle (not shown) integrally formed with the main body. The handle is gripped by a user during use of the iron to enable a user to manoeuvre and position the steam generator iron 50 head unit 40. In the present embodiment, a water receiving chamber (not shown) is disposed in the main body. Water is stored in the water receiving chamber and is fed to a steam generating unit (not shown) which converts the water into steam. The steam generating unit is a boiler with a steam producing chamber (not shown) in which steam is generated at a high pressure by water being heated by a heater (not shown) to convert the water into steam. Upon opening of a steam release valve the steam is then fed along the steam passageway from the steam generating unit. Although the present embodiment relates to a steam generator iron 50 in which the water receiving chamber and steam generating unit are disposed in the head unit 40, it will be appreciated that alternative embodiments are possible. For example, in another embodiment the steam generator iron 50 is a steam system iron in which the water receiving chamber and steam generating unit are disposed in a base unit 42, and steam is fed to a steam generator iron 50 head unit 40 comprising the sole plate through a hose 44. In a further embodiment the steam generator iron 50 is a cold water system iron in which the water receiving chamber is disposed in a base unit 42 and water is fed to a steam generating unit in a steam generator iron 50 head unit 40 comprising the sole plate.

When the steam generator iron 50 is assembled, it will be appreciated that a steam passageway is formed along which steam flows from the steam generating unit (not shown) to outside the steam generator iron 50. The steam passageway extends from the steam generating unit (not shown) along a steam path (not shown) to the steam inlet 15, along the steam inlet cavity 14 to the cyclone chamber 13, through the steam outlet 16 and along the steam conduit 18 to the steam conduit exit aperture 20, passing into the steam dispersal space 9 and through the steam apertures 22 to outside the steam generator iron 50.

A flow stabilising element 24 is disposed in the steam outlet 16, as shown diagrammatically in FIG. 5. The flow stabilising element 24 acts as a noise reduction means to reduce the noise levels generated by the steam generator iron during operation, as will become apparent hereinafter. The flow stabilising element 24 comprises a fluid permeable plug which is located in the bore of the steam outlet 16. A lower end 25 of the flow stabilising element 24 extends from the free end 17 of the steam outlet 16 into the cyclone chamber 13. An upper end 26 of the flow stabilising element 24 extends from the bore of the steam outlet 16 into the steam conduit 18.

Figure 3:
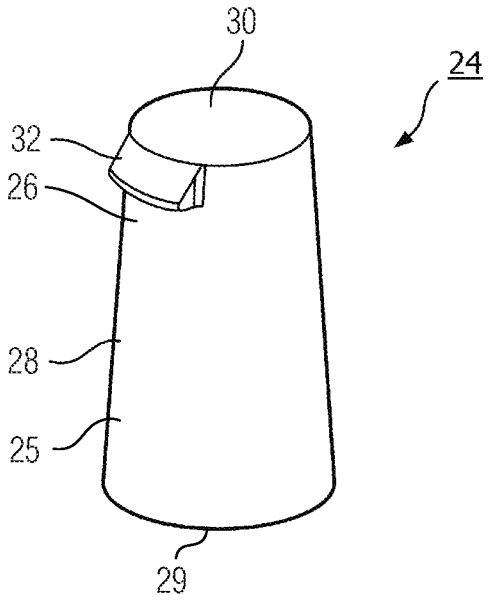
FIG. 3 shows a perspective view of a flow stabilising element receivable in the steam passageway of a steam generator iron sole plate shown in FIGS. 1 and 2.
Figure 10:
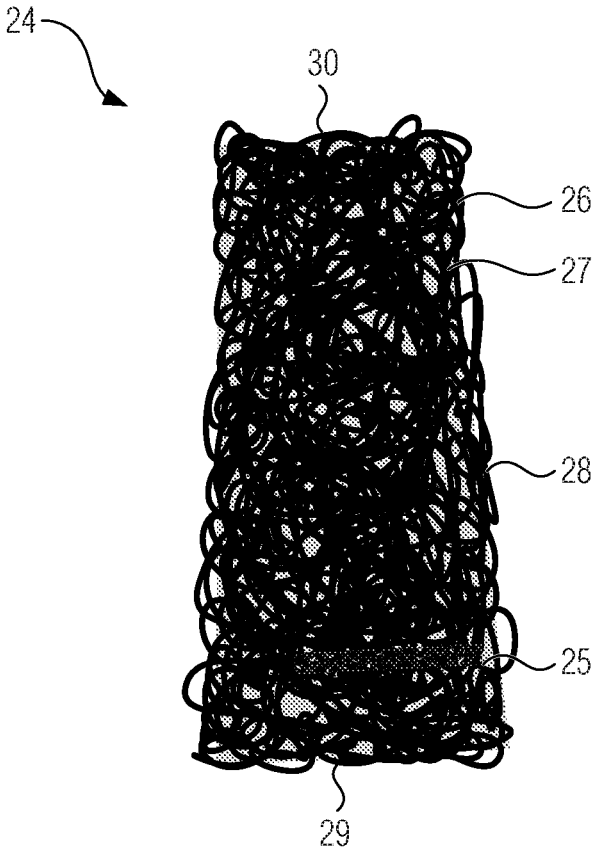
FIG. 10 shows a perspective view of a flow stabilising element formed from a wire mesh of intertwined metal wires.
Figure 11:
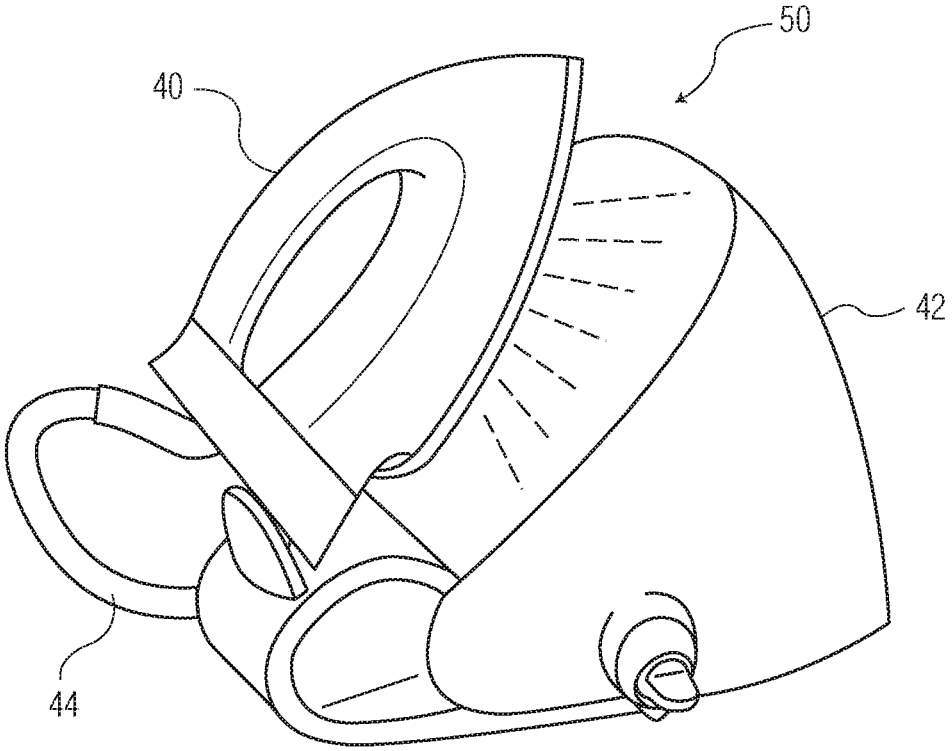
FIG. 11 shows a perspective view of a steam generator iron according to one arrangement with a base unit supplying water and/or steam through a hose to a base unit.

The flow stabilising element 24 is formed from a flexible, but form-stable stainless steel intertwined wire mesh (refer to FIG. 10). This ensures that the wires intertwine, but do not stick to each other to allow some compression and/or extension. In an alternative arrangement, the flow stabilising element is formed from another metal, such as aluminium, or a ceramic. The wire mesh is one or more intertwined metal wires 27 formed in a cylindrical or frustum shape. The flow stabilising element 24 has an outer side surface 28, a lower surface 29 and an upper surface 30 defined by the outermost portions of the wires. Two diametrically opposing tabs 32 (refer to FIG. 3) extend from an upper end of the flow stabilising element 24. The tabs 32 aid location of the flow stabilising element 24 in the steam outlet 16, as will become apparent hereinafter. It will be understood that one or an alternative number of tabs 32 may be used to aid location of the flow stabilising element 24 in the steam outlet 16.

The packing density of the wire mesh and the diameter of the intertwined metal wires 27 forming the wire mesh of the flow stabilising element are configured so that the flow stabilising element stabilises the flow of steam through the fluid passageway. Due to the flexibility of the wires, local pressure gradients are more balanced, resulting in a more stable, and silent flow. This means that the number and severity of the vortices in the flow are reduced and directly reduces sound production. An additional advantage of the flow stabilising element 24 is that the element reduces the flow resistance in the fluid passageway due to the stabilisation of the flow by the flow stabilising element 24, even though the element is disposed in the flow path of the steam.

The intertwined wire mesh is formed from a wire having a diameter in the range of 0.01 mm to about 2 mm, preferably in the range of 0.03 mm to 0.40 mm. The packing density is in the range of 5% to 80%, and preferably in the range of 10% to 30%, wherein a packing density of 30% means that the volume percentage is 30% metal versus 70% open.

The above wire diameter and packing density ranges ensures that the insert is simple to manufacture without significantly limiting the sound reduction achieved by such an insert. For example, it will be appreciated that if the packing density increases beyond 80% then the insert becomes more difficult to fabricate, and a flow resistance is generated by the insert in the gas passageway.

Although in the presently-described embodiment the flow stabilising element 24 is formed from a randomly arranged wire mesh formed into a frustum shape, it will be appreciated that the configuration of the flow stabilising element is not limited thereto. Advantages of the use of a stainless steel metal wire mesh include resistance to temperatures generated in a steam generator iron, corrosion resistance, minimal scale build-up, and a reduction of flow resistance.

Although the above-described flow stabilising element is flexible, it will be appreciated that the flow stabilising element may be formed to have a rigid structure. An advantage of a flexible structure is that it enhances a reduction in the level of noise generated. In an alternative arrangement, the flow stabilising element 24 is, for example, an open cell structure foam formed from a metal or plastic, an insert formed with a labyrinth of smaller channels, or a perforated sheet.

When the steam generator iron is assembled, the flow stabilising element 24 is received in the steam outlet 16. The upper end 26 of the flow stabilising element protrudes from the steam outlet 16 and extends into the steam conduit 18. Similarly, the lower end 25 of the flow stabilising element 24 protrudes from the free end 17 of the steam outlet 16 and extends into the cyclone chamber 13. The lower end 25 of the flow stabilising element 24 is spaced from the base of the cyclone chamber 13. An advantage of spacing the flow stabilising element 24 from the base of the cyclone chamber 13 is to prevent the flow stabilising element 24 from guiding water in the cyclone chamber out of the cyclone chamber 13.

The tabs 32 locate in the steam conduit 18 to fixedly locate the flow stabilising element 24. In the present embodiment the flow stabilising element 24 is fixedly disposed at the transition between the cyclone chamber 13 and the steam outlet 16, as well as the transition between the steam outlet 16 and the steam conduit 18, by the converging side surface of the flow stabilising element 24. However, it will be appreciated that in alternative embodiments, the flow stabilising element 24 is, for example, integrally formed with the steam outlet 16, removably mounted therein to aid cleaning, or fixedly mounted therein by an adhesive or a fixing means.

Operation of the above described embodiments will now be described with reference to FIGS. 1 to 5.

A user fills the water receiving chamber (not shown) with water, and the steam generating unit (not shown) is operated in a conventional manner. The steam generating unit heats water fed into the steam producing chamber (not shown) and boils it to produce steam. The steam produced in the steam producing chamber builds up in the chamber. Upon release of the pressure by a valve the steam is urged to flow along the steam passageway which is fluidly connected to the steam producing chamber.

The steam flows along a path forming part of the steam passageway to the steam inlet 15 formed through the bottom face 6 of the sole plate upper part 2. The steam under a high pressure is then fed into the steam inlet cavity 14 and flows therealong into the cyclone chamber 13. The steam enters the cyclone chamber 13 tangentially at a high flow velocity and so is urged to flow along a rotational path in the cyclone chamber 13. Excess water in the high velocity flow is urged to separate from the steam due to the centrifugal force imparted by the rotational motion and evaporates in the cyclone chamber so that it does not flow out of the steam generator iron in a liquid form, and is converted into steam in the cyclone chamber so as to flow from the steam generator iron as steam.

The free end 17 of the steam outlet 16 extends into the cyclone chamber 13 and is open to the cyclone chamber 13, with the steam flowing at a high velocity in the cyclone chamber 13 being urged to flow from the cyclone chamber 13 through the steam outlet 16 due to the high pressure of the steam in the fluid passageway. However, the steam in the cyclone chamber 13 flows along a rotational path, and is urged to flow into a linear channel. In an arrangement in which a flow stabilising element 24 is not present, as shown in FIG. 4, which is shown as an illustration only, a loud noise is generated at the transition of the cyclone chamber 13 and the steam outlet 16, proximate the free end 17, due to flow instabilities, such as turbulence and vortices, generated by the transition from rotational fluid flow to a more linear fluid flow path. However, in the present invention the flow stabilising element 24 is disposed at the transition of the cyclone chamber 13, which is a first section of the fluid passageway, and the steam outlet 16, which is a second section of the fluid passageway, as shown in FIG. 5. Therefore, the steam flow flows into the flow stabilising element 24 and is stabilised by the steam flowing through the paths formed in the flow stabilising element 24. Therefore, noise levels are minimised by inhibiting the source of sound production without limiting the flow of steam through the steam passageway.

In a known steam generator iron the average sound power levels are typically 80 dB(A) to 85 dB(A) when ironing on an ironing board. However, by implementing a flow stabilising element 24 it is possible to reduce the sound levels of a steam generator iron to a level of about 65 dB(A), without a loss of performance.

In the present arrangement, the lower end of the flow stabilising element 24 extends from the free end 17 of the steam outlet 16 and into the cyclone chamber 13 to further stabilise the flow of air into the steam outlet 16. Similarly, the upper end of the flow stabilising element 24 extends into the steam conduit 18, which is a third section of the fluid passageway, to stabilise the flow of air around the corner representing the transition between the steam outlet 16 and the steam conduit 18, and so minimise the noise generated at this transition.

The steam then flows along the steam conduit 18 and through the steam conduit exit 20 into the steam dispersal chamber 9, from which the steam flows out of the steam apertures 22 to a garment to be pressed.

Although the flow stabilising element 24 is described above to minimise the noise levels generated in the steam passageway, it will also be appreciated that the implementation of one or more flow stabilising elements into the steam passageway of a steam generator iron may be used to create a more compact or complex arrangement without increasing the sound levels of the steam generator iron during use. The flow stabilising element also has the effect of reducing the flow resistance in the fluid passageway by stabilising the flow of the steam along the fluid passageway.

In the above arrangement, it will be appreciated that the dominant noise source is located at the transition of the flow around the free end of the steam outlet, and the flow stabilising element 24 is fixedly disposed at the transition between the cyclone chamber 13 and the steam outlet 16, as well as the transition between the steam outlet 16 and the steam conduit 18. However, it will be appreciated that a flow stabilising element 24 may be located at one or more alternative transition points along the steam passageway to stabilise the flow at that position or positions of the steam passageway and so to limit the noise generated.

In particular, turbulence or vortices are generated at a transition between one geometrical configuration in one section of the flow path and another geometrical configuration in another section of the flow path, for example a bend in the fluid passageway, a transition in the diameter of the fluid passageway, a transition between a chamber and a fluid channel, or a transition from a rotational flow to a straight flow, as described above with reference to FIGS. 4 and 5.

Figure 6:
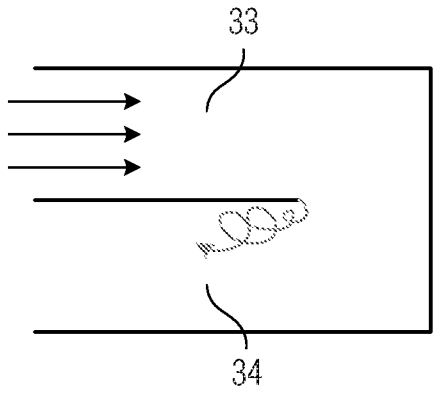
FIG. 6 shows a diagrammatic view of a steam passageway along a steam passageway according to one arrangement with a flow stabilising element removed.
Figure 7:
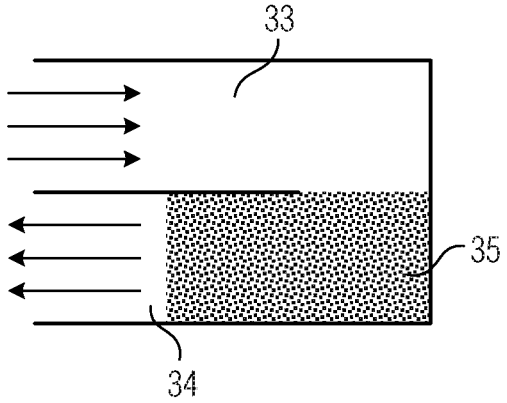
FIG. 7 shows a diagrammatic view of a steam passageway along a steam passageway according to one arrangement with a flow stabilising element present.

An example of a transition in the flow path between a first section 33 of the fluid passageway and a second section 34 of the fluid passageway is shown in FIGS. 6 and 7. In this configuration the fluid passageway extends around a corner so that the second section 34 of the fluid passageway extends in an opposing direction to the first section 33 of the fluid passageway. In FIG. 7, the configuration is shown with a flow stabilising element 35 disposed at the transition between the first section 33 and the second section 34, whereas in FIG. 6 the configuration is shown as an illustration only without a flow stabilising element.

When the flow stabilising element 35 is absent, turbulence and/or vortices are created at the corner forming the transition between the first and second sections 33, 34 of the fluid passageway. However, when the flow stabilising element 35 is disposed at the transition between the first and second sections 33, 34 the flow stabilising element acts to stabilise the flow and so minimise the generation of flow instabilities, such as turbulence and vortices. Therefore, the noise level generated at the transition between the first and second sections is minimised, and the overall sound level of the steam generator iron during operation is minimised. The flow stabilising element 35 also has the effect of reducing the flow resistance in the fluid passageway by stabilising the flow of the steam along the fluid passageway.

Although in FIG. 7 the flow stabilising element is shown in the second section so that it is disposed at the transition from the first to second sections, it will be appreciated that the flow stabilising element is alternatively disposed in the first section, or extending from the first or second section into the other section, so that it is disposed at the transition from the first to second sections.

Figure 8:
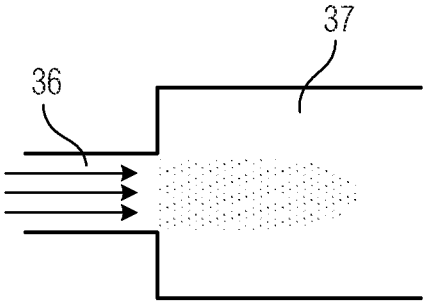
FIG. 8 shows a diagrammatic view of a steam passageway along a steam passageway according to another arrangement with a flow stabilising element removed.
Figure 9:
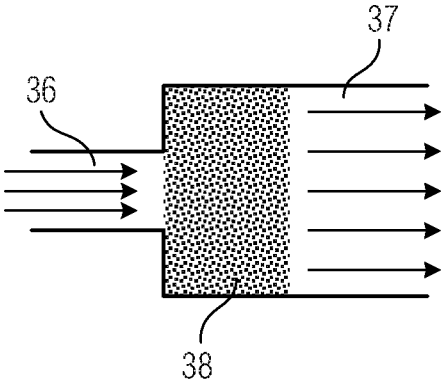
FIG. 9 shows a diagrammatic view of a steam passageway along a steam passageway according to another arrangement with a flow stabilising element present.

Another example of a transition in the flow path between a first section 36 of the fluid passageway and a second section 37 of the fluid passageway is shown in FIGS. 8 and 9. In this configuration the diameter of the second section 37 fluid passageway is greater than the first section 36 of the fluid passageway. In FIG. 9, the configuration is shown with a flow stabilising element 38 disposed at the transition between the first section 36 and the second section 37, whereas in FIG. 8 the configuration is shown as an illustration only without a flow stabilising element.

When the flow stabilising element 38 is absent, turbulence and/or vortices are created at the transition between the first and second sections 36, 37 of the fluid passageway. However, when the flow stabilising element 38 is disposed in the second section 37 at the transition between the first and second sections 36, 37 the flow stabilising element acts to stabilise the flow and so minimise the generation of flow instabilities, such as turbulence and vortices. Therefore, the noise level generated at the transition between the first and second sections is minimised, and the overall sound level of the steam generator iron during operation is minimised. The flow stabilising element 38 also has the effect of reducing the flow resistance in the fluid passageway by stabilising the flow of the steam along the fluid passageway.

In the above described embodiments the water receiving chamber and steam generating unit are disposed in the steam generator iron head unit of the steam generator iron. However, it will be appreciated that the above described arrangement may also be used with alternative systems that provide a pressurised steam flow, for example a steam system iron.

A steam system iron (not shown) comprises a base unit 42 in which a steam generating unit is disposed and a separate steam generator iron 50 head unit 40 which are connected by a flexible hose 44. The steam generator iron 50 head unit 40 is held by a user and has a sole plate which is pressed against the fabric of a garment. The arrangement of the steam generator iron 50 head unit 40 is similar to that of the steam generator iron 50 head unit 40 described in the foregoing embodiments, and so a detailed description will be omitted herein. However, in the present embodiment the steam generating unit including the steam generating chamber are disposed in the separate base unit 42. The steam generated in the base unit 42 is fed to the steam generator iron 50 head unit 40 through the flexible hose 44, and steam generated by the steam generating unit in the base unit 42 flows along the hose 44 to the main body. The steam is then discharged from the steam generator iron 50 head unit 40 through the steam apertures in the sole plate.

Similarly, in a cold water system iron (not shown), a water receiving chamber is disposed in a base unit 42 and a separate steam generator iron head unit 40 is connected to the base unit 42 by a flexible hose 44. The steam generator iron head unit 40 is held by a user and the sole plate is pressed against the fabric of a garment. The arrangement of the steam generator iron head unit 40 is similar to that of the steam generator iron head unit 40 described in the foregoing embodiments, and so a detailed description will be omitted herein. However, in the present embodiment water is fed from the water receiving chamber in the base unit 42 to the steam generator iron head unit 40 through a flexible hose 44, and is then converted into steam by a steam generating unit in the steam generator iron head unit 40 and discharged from the main body through the steam apertures in the sole plate.

It will be appreciated that the term "comprising" does not exclude other elements or steps and that the indefinite article "a" or "an" does not exclude a plurality. A single processor may fulfil the functions of several items recited in the claims. The mere fact that certain measures are recited in mutually different dependent claims does not indicate that a combination of these measures cannot be used to an advantage. Any reference signs in the claims should not be construed as limiting the scope of the claims.

Although claims have been formulated in this application to particular combinations of features, it should be understood that the scope of the disclosure of the present invention also includes any novel features or any novel combinations of features disclosed herein either explicitly or implicitly or any generalisation thereof, whether or not it relates to the same invention as presently claimed in any claim and whether or not it mitigates any or all of the same technical problems as does the parent invention. The applicants hereby give notice that new claims may be formulated to such features and/or combinations of features during the prosecution of the present application or of any further application derived therefrom.

The invention claimed is:

1. A steam generator iron comprising a steam passageway along which steam flows having a first section, and a second section extending from the first section, the second section being configured to have a different geometrical configuration to the first section, wherein a flow stabilising element configured to minimise vortices and/or turbulence is disposed at the transition of the steam passageway from the first section to the second section, wherein the steam passageway comprises a third section extending from the second section, the flow stabilising element extending to the transition of the steam passageway from the second section to the third section, wherein the steam passageway extends around a corner such that the steam passageway in the second section extends in an opposing direction to the first section.

2. A steam generator iron according to claim 1, wherein the first section defines a cyclonic chamber and the first section is configured to generate a rotational flow of steam and water in the chamber.

3. A steam generator iron according to claim 1, wherein the flow stabilising element extends into the first section.

4. A steam generator iron according to claim 1, wherein the flow stabilising element is formed from a mesh or a foam.

5. A steam generator iron according to claim 4, wherein the flow stabilising element is formed from an intertwined metal wire mesh.

6. A steam generator iron according to claim 5, wherein the intertwined wire mesh is formed from a wire having a diameter of 0.01 mm to 2 mm.

7. A steam generator iron according to claim 6, wherein the intertwined wire mesh is formed from a wire having a packing density of 5% to 80%.

8. A steam generator iron according to claim 1, wherein the diameter of the second section of the steam passageway is smaller than the diameter of the first section.

9. A steam generator iron according to claim 1, wherein the orientation of the longitudinal axis of the second section of the steam passageway is different to the orientation of the longitudinal axis of the first section of the steam passageway.

10. A steam generator iron according to claim 9, wherein the second section extends from a side wall of the first section.

11. A steam generator iron according to claim 1, wherein the second section comprises a tubular portion with a free end of the tubular portion protruding into a flow path formed in the first section, the transition to the second section from the first section being formed at the free end of the tubular portion.

12. A steam generator iron according to claim 1, further comprising a head unit and a base unit, wherein the steam passageway is disposed in the head unit and a water receiving chamber and/or a steam generating unit is disposed in the base unit and water and/or steam is supplied from the base unit to the head unit through a hose.

13. An insert for a steam generator iron comprising a flow stabilising element configured to minimize vortices and/or turbulence and to be disposed in a steam passageway of a steam generator iron and having at least one steam flow path formed therethrough so that, when the insert is disposed in a steam passageway, the flow of steam along a steam passageway is stabilised, wherein the steam generator iron comprises the steam passageway along which said steam flows having a first section, and a second section extending from the first section, the second section being configured to have a different geometrical configuration to the first section, wherein the flow stabilising element extends to the transition of the steam passageway from the second section to a third section extending from the second section, wherein the steam passageway extends around a corner such that the steam passageway in the second section extends in an opposing direction to the first section.

14. A steam generator iron comprising a steam passageway along which steam flows having a first section, and a second section extending from the first section, the second section being configured to have a different geometrical configuration to the first section, wherein a flow stabilising element configured to minimise vortices and/or turbulence is disposed at the transition of the steam passageway from the first section to the second section, wherein the steam passageway comprises a third section extending from the second section, the flow stabilising element extending into the transition of the steam passageway from the second section to the third section.

15. A steam generator iron according to claim 14, wherein the first section defines a cyclonic chamber and the first section is configured to generate a rotational flow of steam and water in the chamber.

16. A steam generator iron according to claim 14, wherein the flow stabilising element extends into the first section.

17. A steam generator iron according to claim 14, wherein the flow stabilising element is formed from a mesh or a foam.

18. A steam generator iron according to claim 17, wherein the flow stabilising element is formed from an intertwined metal wire mesh.

19. A steam generator iron according to claim 18, wherein the intertwined wire mesh is formed from a wire having a diameter of 0.01 mm to 2 mm.

20. A steam generator iron according to claim 19, wherein the intertwined wire mesh is formed from a wire having a packing density of 5% to 80%.

21. A steam generator iron according to claim 14, wherein the orientation of the longitudinal axis of the second section of the steam passageway is different to the orientation of the longitudinal axis of the first section of the steam passageway.

22. A steam generator iron according to claim 21, wherein the second section extends from a side wall of the first section.

23. A steam generator iron according to claim 14, wherein the second section comprises a tubular portion with a free end of the tubular portion protruding into a flow path formed in the first section, the transition to the second section from the first section being formed at the free end of the tubular portion.

24. A steam generator iron comprising a steam passageway along which steam flows having a first section, and a second section extending from the first section, the second section being configured to have a different geometrical configuration to the first section, wherein a flow stabilising element configured to minimise vortices and/or turbulence is disposed at the transition of the steam passageway from the first section to the second section, wherein the steam passageway comprises a third section extending from the second section, the flow stabilising element extending to the transition of the steam passageway from the second section to the third section, wherein the first section defines a cyclonic chamber and the first section is configured to generate a rotational flow of steam and water in the chamber.

25. A steam generator iron according to claim 24, wherein the flow stabilising element is formed from a mesh or a foam.

26. A steam generator iron according to claim 25, wherein the flow stabilising element is formed from an intertwined metal wire mesh.

27. A steam generator iron according to claim 26, wherein the intertwined wire mesh is formed from a wire having a diameter of 0.01 mm to 2 mm.

28. A steam generator iron according to claim 27, wherein the intertwined wire mesh is formed from a wire having a packing density of 5% to 80%.

29. A steam generator iron according to claim 24, wherein the diameter of the second section of the steam passageway is smaller than the diameter of the first section.

30. A steam generator iron according to claim 24, wherein the orientation of the longitudinal axis of the second section of the steam passageway is different to the orientation of the longitudinal axis of the first section of the steam passageway.

31. A steam generator iron according to claim 30, wherein the second section extends from a side wall of the first section.

32. A steam generator iron according to claim 24, wherein the second section comprises a tubular portion with a free end of the tubular portion protruding into a flow path formed in the first section, the transition to the second section from the first section being formed at the free end of the tubular portion.

33. A steam generator iron according to claim 24, further comprising a head unit and a base unit, wherein the steam passageway is disposed in the head unit and a water receiving chamber and/or a steam generating unit is disposed in the base unit and water and/or steam is supplied from the base unit to the head unit through a hose.

* * * * *